US008873977B2

(12) United States Patent
Takahira et al.

(10) Patent No.: US 8,873,977 B2
(45) Date of Patent: Oct. 28, 2014

(54) IMAGE FORMING APPARATUS

(71) Applicants: Masafumi Takahira, Osaka (JP); Haruo Hashimoto, Osaka (JP)

(72) Inventors: Masafumi Takahira, Osaka (JP); Haruo Hashimoto, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 60 days.

(21) Appl. No.: 13/778,234

(22) Filed: Feb. 27, 2013

(65) Prior Publication Data

US 2013/0243445 A1 Sep. 19, 2013

(30) Foreign Application Priority Data

Mar. 13, 2012 (JP) ..... 2012-056448

(51) Int. Cl.
*G03G 15/00* (2006.01)
*G03G 15/08* (2006.01)
*G03G 21/16* (2006.01)

(52) U.S. Cl.
CPC ..... *G03G 15/0898* (2013.01); *G03G 15/0886* (2013.01); *G03G 21/1633* (2013.01); *G03G 21/1676* (2013.01)
USPC ..... 399/13; 399/107; 399/110; 399/111; 399/120

(58) Field of Classification Search
USPC ..... 399/13, 24, 25, 107, 110, 111, 119, 399/120, 252, 258
See application file for complete search history.

(56) References Cited

U.S. PATENT DOCUMENTS 6,564,029 B2 * 5/2003 Kojima et al. ..... 399/258
7,558,515 B2 * 7/2009 Kurita et al. ..... 399/262
8,019,252 B2 * 9/2011 Funada et al. ..... 399/110

FOREIGN PATENT DOCUMENTS

JP 2001-222160 8/2001
JP 2005-049900 2/2005

* cited by examiner

*Primary Examiner* — Hoan Tran
(74) *Attorney, Agent, or Firm* — Harness, Dickey & Pierce, P.L.C.

(57) ABSTRACT

An image forming apparatus including an upper cover, an image forming unit including an image carrier and a developing device, a toner container detachably connectable to the developing device to supply toner to the developing device through an opening in the toner container, a shutter provided to the toner container and biased by a first elastic member in a direction to close the opening of the toner container, a link member integrated with the shutter, a shutter switching member to switch a position of the shutter to an open position by moving the link member to a pressing position, and an interlock mechanism to retract the shutter switching member from the pressing position in conjunction with opening of the upper cover. The opening is closed with the shutter by switching the shutter switching member to a retracted position in conjunction with the opening of the upper cover.

14 Claims, 8 Drawing Sheets

FIG. 9

| | a | b | c | d | e |
|---|---|---|---|---|---|
| | | | | AT LEAST ONE PROCESS UNIT IS NOT DETECTED | ALL PROCESS UNITS ARE DETECTED |
| UPPER COVER | CLOSED | OPENED | CLOSED | CLOSED | CLOSED |
| SOLENOID | — | — | — | DE-ENERGIZED | ENERGIZED |
| LATCH | RELEASED | LOCKED | LOCKED | LOCKED | RELEASED |
| SHUTTER | OPENED : d1 | CLOSED : d0 | CLOSED : d0 | CLOSED : d0 | OPENED : d1 |
| TONER SUPPLY OPENING | OPENED | CLOSED | CLOSED | CLOSED | OPENED |
| CORRESPONDING DRAWING | 【FIG. 2】 | 【FIG. 4】 | 【FIG. 5】 | | 【FIG. 2】 |

IMAGE FORMING APPARATUS

CROSS-REFERENCE TO RELATED APPLICATION

This patent application is based on and claims priority pursuant to 35 U.S.C. §119 to Japanese Patent Application No. 2012-056448, filed on Mar. 13, 2012, in the Japan Patent Office, the entire disclosure of which is hereby incorporated by reference herein.

BACKGROUND OF THE INVENTION

1. Field of the Invention

Exemplary aspects of the present invention generally relate to an image forming apparatus employing an electrophotographic method such as a printer, copier, or facsimile machine, and more particularly to an image forming apparatus that reliably prevents toner scattering upon detachment of an image forming unit from the image forming apparatus.

2. Description of the Related Art

Related-art image forming apparatuses, such as copiers, printers, facsimile machines, and multifunction devices having two or more of copying, printing, and facsimile capabilities, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

In order to meet increasing demand for compact apparatuses with easy maintenance, the photoconductor, the developing device, and so on are often formed together within a cartridge casing as a single integrated image forming unit detachably installable in the image forming apparatus. An example of the image forming unit includes, but is not limited to, a process cartridge including a photoconductor unit (PCU) or a photoconductor development unit (PCDU). Each image forming unit has a toner reception opening connected to a separate toner cartridge so that toner is supplied from the toner cartridge to the developing device included in the image forming unit via the toner reception opening. When the toner cartridge is detached for replacement, however, toner may spill from the toner reception opening and soil the interior and exterior of the image forming apparatus, the user, or both.

Related-art process cartridges employ a configuration in which a slidable shutter member is provided inside a casing of the process cartridge. Installation and detachment of the process cartridge in and from the image forming apparatus slides the shutter open and closed, thereby preventing toner from escaping during installation and detachment. Alternatively, an All-in-One (AIO) system may be employed to form a toner bottle and a process cartridge together as a single integrated unit. Although the configuration employing the AIO system prevents toner from spilling and scattering, when the toner is used up, not only the toner bottle but also the process cartridge must be replaced with a new toner bottle and a process cartridge together at the same time, thereby needlessly increasing costs.

In yet another approach, a closably openable cover is provided to an upper part of the image forming apparatus so that it can be opened even under cramped conditions of installation. However, in a case in which the process cartridge to which the toner cartridge is attached above the process cartridge is used in such an image forming apparatus, upon replacement of the process cartridge or the toner cartridge, it is necessary to close a shutter provided to a discharge opening of the toner cartridge before detachment of the toner cartridge from the image forming apparatus. In addition, the toner cartridge must be detached before detachment of the process cartridge from the image forming apparatus upon replacement of the process cartridge. Consequently, easy replacement of the toner cartridge or the process cartridge is hindered.

In particular, upon replacement of multiple process cartridges used for a full-color image forming apparatus with multiple new process cartridges, respectively, first the toner cartridges are individually detached from the image forming apparatus after the shutters provided to the toner cartridges are closed, and then the process cartridges are individually detached from the image forming apparatus, thereby complicating replacement of the process cartridges. Further, because the toner discharge openings of the toner cartridges are individually closed or opened with the respective shutters upon replacement of the multiple toner cartridges or process cartridges, the installation and detachment of the toner cartridges or the process cartridges in and from the image forming apparatus are further complicated.

A harness or the like is often used to install multiple toner cartridges together at the same time above the multiple process cartridges in the image forming apparatus. However, inadvertently opening the shutters of the toner cartridges after replacement of the process cartridges without noticing the absence of at least one process cartridge in the image forming apparatus causes toner to spill inside the image forming apparatus from the toner cartridge and soils the image forming apparatus.

SUMMARY OF THE INVENTION

In view of the foregoing, illustrative embodiments of the present invention provide a novel image forming apparatus in which shutters respectively provided to multiple toner cartridges are opened or closed together at the same time in conjunction with opening and closing of an upper cover of the image forming apparatus upon replacement of the multiple toner cartridges or image forming units to prevent toner from spilling inside the image forming apparatus from the toner cartridges. In a case in which absence of at least one image forming unit is detected, the shutters of the toner cartridges are prevented from being opened.

In one illustrative embodiment, an image forming apparatus includes an upper cover, an image forming unit including an image carrier and a developing device to develop an electrostatic latent image formed on the image carrier with developer, a toner container detachably connectable to the developing device to supply toner to the developing device through an opening in the toner container, a shutter provided to the toner container and biased by a first elastic member in a direction to close the opening of the toner container with an elastic force, a link member integrated with the shutter, a shutter switching member to switch a position of the shutter to an open position against the elastic force of the first elastic member by applying an elastic force of a second elastic member to the link member and moving the link member to a pressing position, and an interlock mechanism to retract the shutter switching member from the pressing position against the elastic force of the second elastic member in conjunction with opening of the upper cover of the image forming apparatus. The opening is closed with the shutter receiving the elastic force of the first elastic member by switching the shutter switching member to a retracted position in conjunction with the opening of the upper cover.

Additional features and advantages of the present disclosure will become more fully apparent from the following detailed description of illustrative embodiments, the accompanying drawings, and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 9 is a graph showing states of a release mechanism, the latch mechanism, and a shutter, respectively, based on opening/closing movement of the upper cover;

DETAILED DESCRIPTION OF THE INVENTION

Figure 1:
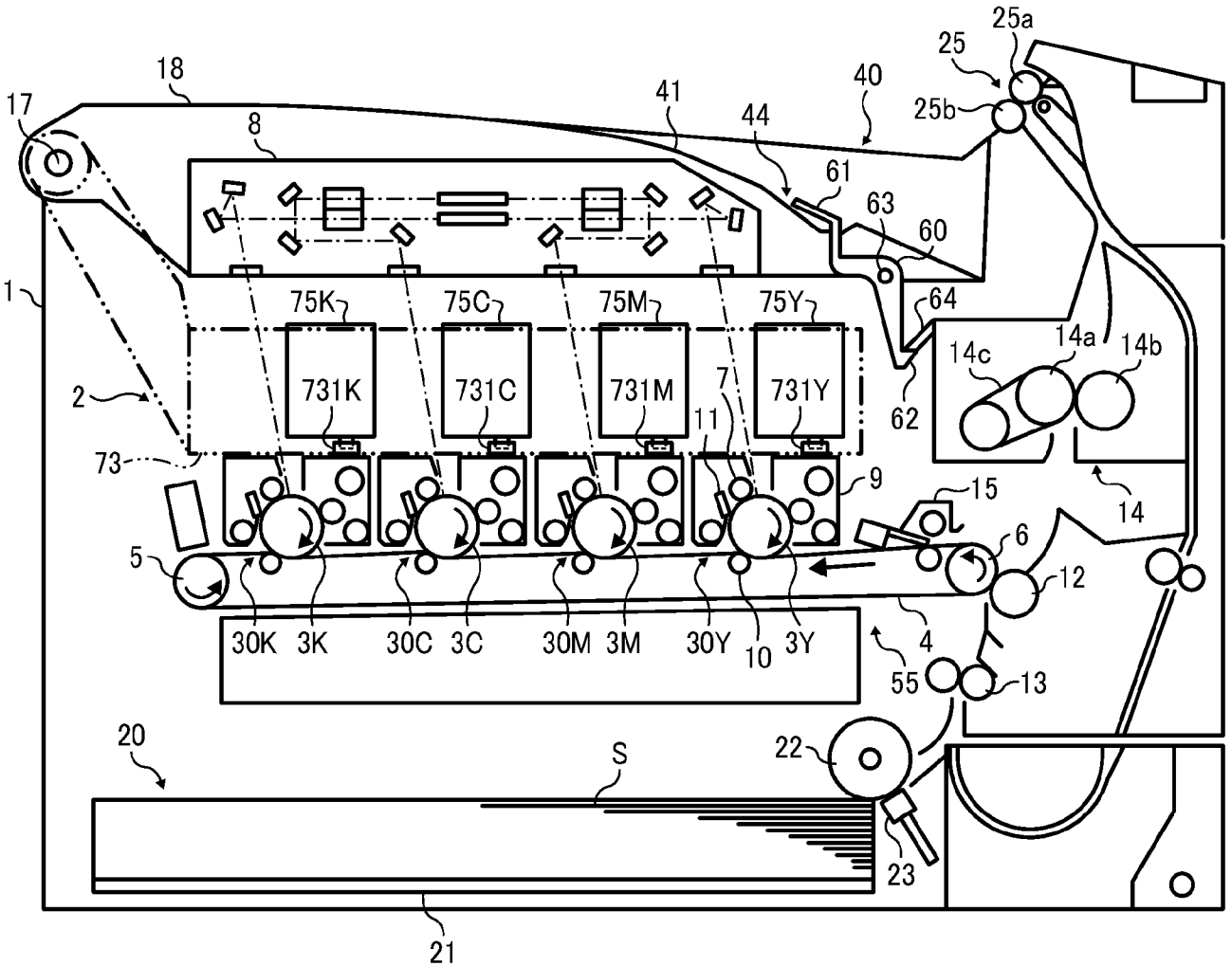
FIG. 1 is a vertical cross-sectional view illustrating an example of a configuration of an image forming apparatus according to a first illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have substantially the same function, operate in a similar manner, and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

Figure 2:
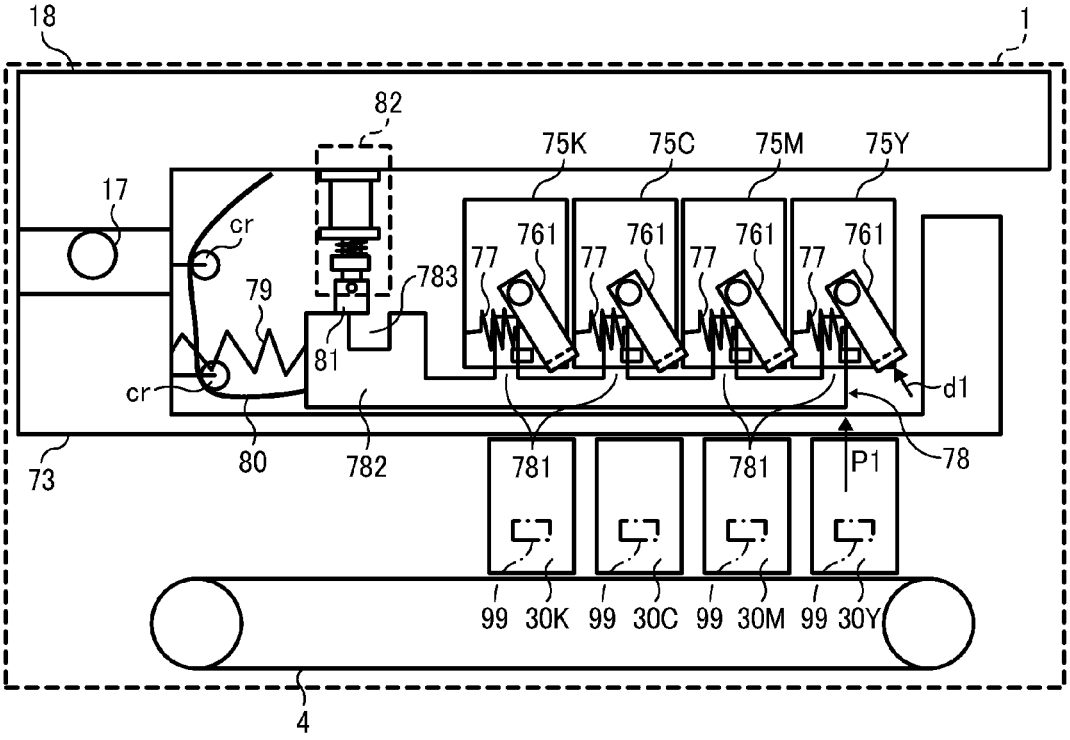
FIG. 2 is a schematic vertical cross-sectional view illustrating the configuration of the image forming apparatus in a normal state.

A configuration and operation of a tandem-type full-color image forming apparatus 1 according to a first illustrative embodiment are described below with reference to FIGS. 1 and 2. FIG. 1 is a vertical cross-sectional view illustrating an example of a configuration of the image forming apparatus 1 according to the first illustrative embodiment. FIG. 2 is a vertical cross-sectional view illustrating the configuration of the image forming apparatus 1 in a normal state.

The image forming apparatus 1 includes an image forming part 2 that forms an image on a recording medium such as a sheet of paper (hereinafter referred to as sheet S), a sheet feeder 20 disposed below the image forming part 2 to feed the sheet S to the image forming part 2, a sheet discharger 25 that discharges the sheet S having the image formed by the image forming part 2 thereon from the image forming apparatus 1, and a discharge tray 41 disposed above the image forming part 2, on which the sheet S discharged by the sheet discharger 25 is stacked. It is to be noted that examples of the sheet S include, but are not limited to, a transfer sheet, a recording sheet, coated paper, film, and tracing paper.

The image forming part 2 includes multiple image carriers, which in the present illustrative embodiment, are drum-type photoconductors 3Y, 3M, 3C, and 3K (hereinafter collectively referred to as photoconductors 3). A toner image of a specified color, that is, yellow (Y), magenta (M), cyan (C), or black (K), is formed on the photoconductors 3, respectively. The photoconductors 3 are disposed parallel to one another at predetermined intervals. An intermediate transfer body, which, in the present illustrative embodiment, is an intermediate transfer belt 4 is disposed below and opposite the photoconductors 3. The intermediate transfer belt 4 is wound around multiple support rollers 5 and 6 to be rotated in a counterclockwise direction in FIG. 1.

A configuration around each photoconductor 3Y, 3M, 3C, or 3K is basically the same, differing only in the color of toner used. Therefore, a configuration of the photoconductor 3Y disposed on the extreme right in FIG. 1 is described in detail below as representative. It is to be noted that reference numerals respectively denoting components provided around each photoconductor 3 are shown only for the photoconductor 3Y in FIG. 1, without the suffix Y.

A charging roller 7 that evenly charges a surface of the photoconductor 3Y, an irradiation position on the surface of the photoconductor 3Y, onto which laser light emitted from a laser scanning unit (LSU) 8 is directed based on image data to form an electrostatic latent image on the surface of the photoconductor 3Y, a developing device 9 that develops the electrostatic latent image with toner to form a toner image on the surface of the photoconductor 3Y, a primary transfer roller 10 provided opposite the photoconductor 3Y with the intermediate transfer belt 4 interposed therebetween, and a cleaning blade 11 that removes residual toner from the surface of the photoconductor 3Y after primary transfer of the toner image from the surface of the photoconductor 3Y onto the intermediate transfer belt 4 are disposed, in that order, in a direction of rotation of the photoconductor 3Y. Toner containers, which, in the present illustrative embodiment, are toner cartridges 75Y, 75M, 75C, and 75K (hereinafter collectively referred to as toner cartridges 75) and respective supply mechanisms, not shown, are disposed above the developing devices 9 respectively provided around the photoconductors 3. The supply mechanisms are driven based on an amount of toner consumed in the respective developing devices 9 so that toner is supplied from the toner cartridges 75 to the respective developing devices 9 via a supply opening 751 provided to each toner cartridge 75.

When the image forming apparatus 1 starts image formation, the photoconductors 3 are rotated in a clockwise direction in FIG. 1. Describing the image forming process performed on the photoconductor 3Y as representative, first the charging roller 7 evenly charges the surface of the photoconductor 3Y to a predetermined polarity. Next, laser light is directed from the LSU 8 onto the charged surface of the photoconductor 3Y based on image data so that an electrostatic latent image is formed on the surface of the photoconductor 3Y. The electrostatic latent image thus formed on the surface of the photoconductor 3Y is then developed by the developing device 9 with yellow toner so that a yellow toner image is formed on the surface of the photoconductor 3Y. Thereafter, the yellow toner image is primarily transferred onto the intermediate transfer belt 4 from the surface of the photoconductor 3Y by the primary transfer roller 10.

The above-described image forming process is also performed on the photoconductors 3M, 3C, and 3K, respectively, during full-color image formation. Accordingly, yellow (Y), magenta (M), cyan (C), and black (K) toner images are sequentially transferred from the photoconductors 3 onto the intermediate transfer belt 4 and superimposed one atop the other to form a single full-color toner image on the intermediate transfer belt 4.

The image forming apparatus 1 further includes a secondary transfer roller 12 provided opposite the support roller 6 with the intermediate transfer belt 4 interposed therebetween. The sheet feeder 20 disposed below the image forming part 2 includes a sheet tray 21 that accommodates the sheet S, a sheet feed roller 22 that feeds the sheet S from the sheet tray 21, and a friction pad 23 that separates the sheet S fed from the sheet tray 21 one by one. The sheet S fed from the sheet feeder 20 is conveyed to a pair of registration rollers 13. Rotation of the pair of registration rollers 13 is stated in synchronization with the full-color toner image formed on the intermediate transfer belt 4 to convey the sheet S to a secondary transfer position between the intermediate transfer belt 4 and the secondary transfer roller 12. Accordingly, the full-color toner image is secondarily transferred onto the sheet S from the intermediate transfer belt 4 by the secondary transfer roller 12.

The sheet S having the full-color toner image thereon is then conveyed to a fixing device 14. The fixing device 14 includes a fixing roller 14*a*, a fixing belt 14*c* wound around the fixing roller 14*a*, and a pressing roller 14*b* pressed against the fixing roller 14*a* via the fixing belt 14*c*. In the fixing device 14, heat and pressure are applied to the sheet S so that the full-color toner image is fixed onto the sheet S. Thereafter, the sheet S having the fixed image thereon is discharged to a sheet stacking unit 40 provided to an upper surface of the image forming apparatus 1 by a pair of discharge rollers 25*a* and 25*b* included in the sheet discharger 25. After secondary transfer of the full-color toner image from the intermediate transfer belt 4 onto the sheet S, a belt cleaning device 15 removes residual toner remaining attached to the surface of the intermediate transfer belt 4 to be ready for the next sequence of image formation. The above-described image forming processes are controlled by a control unit, not shown.

An upper cover 18 that covers an upward opening of the image forming apparatus 1 provided above the image forming part 2 is provided to an upper portion of the image forming apparatus 1. An upper surface of the upper cover 18 is used as the discharge tray 41 of the sheet stacking unit 40. A rear edge of the upper cover 18 is hinged to a rear edge of the image forming apparatus 1 by a hinge 17.

Figure 4:
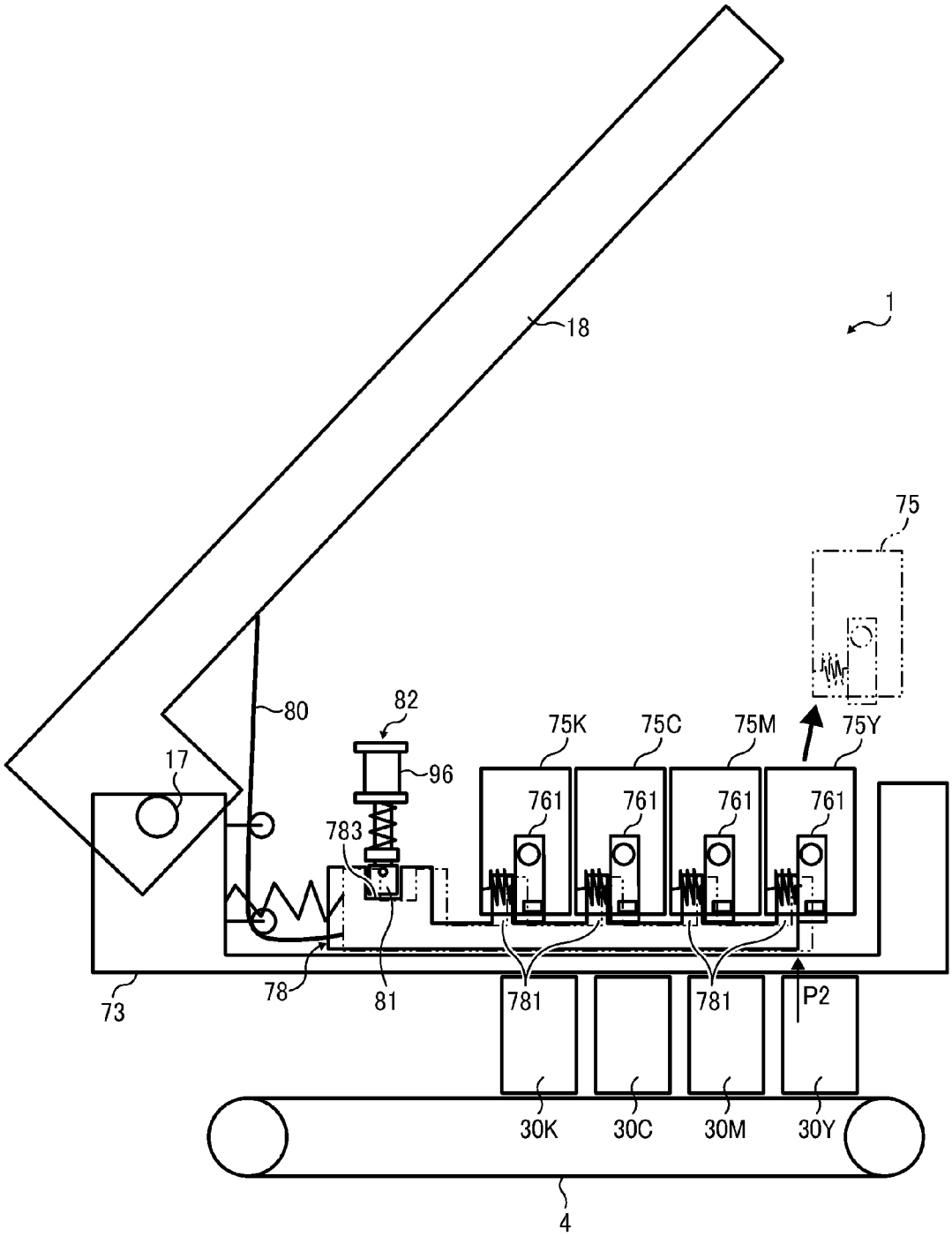
FIG. 4 is a vertical cross-sectional view illustrating the configuration of the image forming apparatus when an upper cover is opened.

The upper cover 18 is openable by swinging upward around the hinge 17, and a lower part of the upper cover 18 supports the LSU 8, which is a part of the image forming part 2. The upper cover 18 is locked by a lock member, which, in the present illustrative embodiment, is a lock lever 60. When the lock lever 60 is released, the upper cover 18 is openable upward. When the upper cover 18 is opened upward as illustrated in FIG. 4 described later, the LSU 8 is also moved upward together with the upper cover 18. Accordingly, a user can easily access the image forming part 2, thereby facilitating maintenance. While the upper cover 18 is opened, image forming units, which, in the present illustrative embodiment, are process units 30Y, 30M, 30C, and 30K (hereinafter collectively referred to as process cartridges 30), each constructed of the corresponding photoconductor 3, charging roller 7, developing device 9, and cleaning device 11 as a single integrated unit, can be installed in or detached from the image forming apparatus 1 for replacement.

In order to open the upper cover 18 upward, the user inserts his or her hand into a recessed portion 44 to lift an operating part 61 of the lock lever 60 against a biasing force of a torsion coil spring, not shown, so that the lock lever 60 is rotated in a clockwise direction in FIG. 1 around a pin 63 and a lock pawl 62 of the lock lever 60 is disengaged from a protrusion 64 provided to the image forming apparatus 1. As the operating part 61 is further lifted, the upper cover 18 swings upward around the hinge 17.

Figure 3:
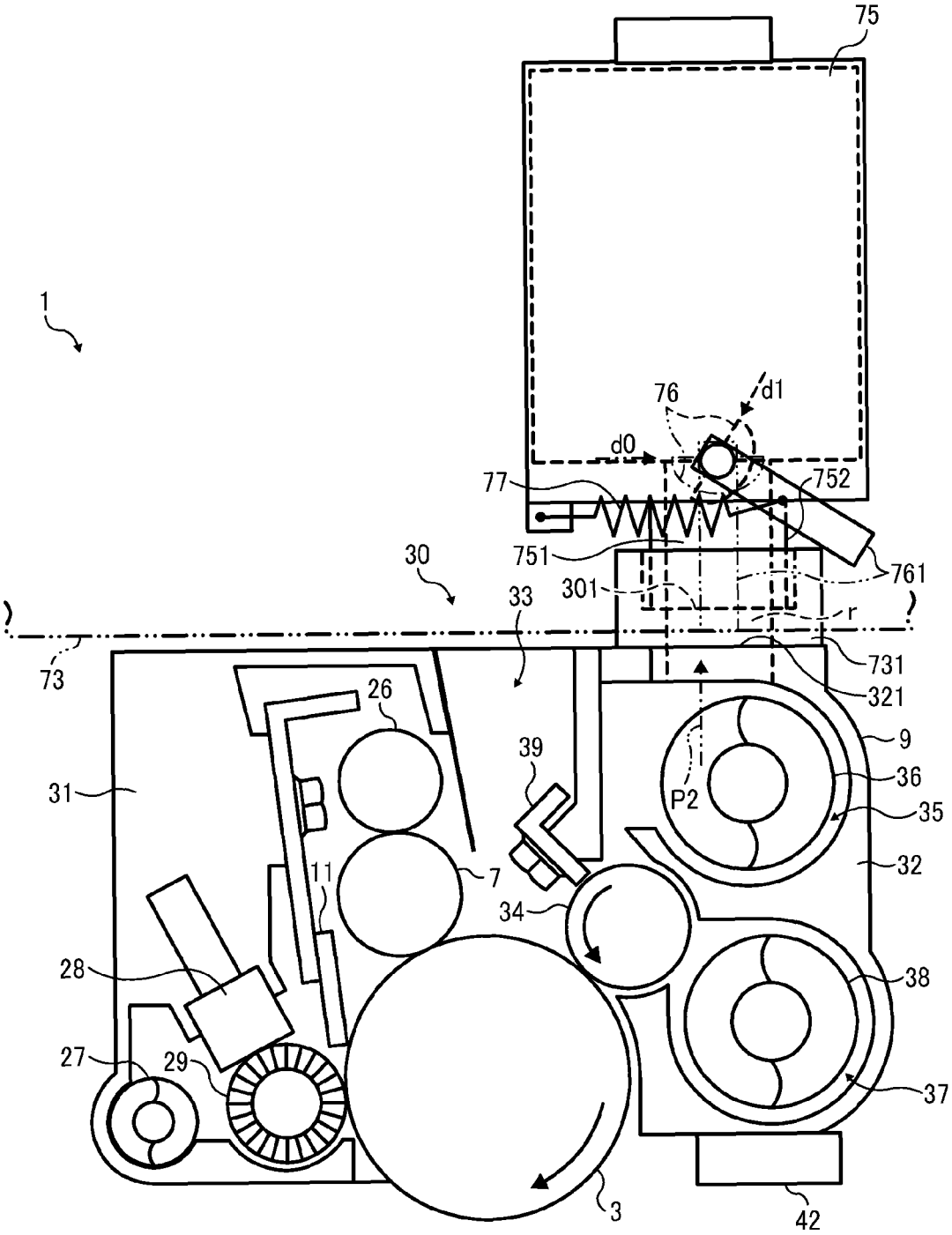
FIG. 3 is a vertical cross-sectional view illustrating an example of a configuration of a process unit installed in the image forming apparatus.
Figure 5:
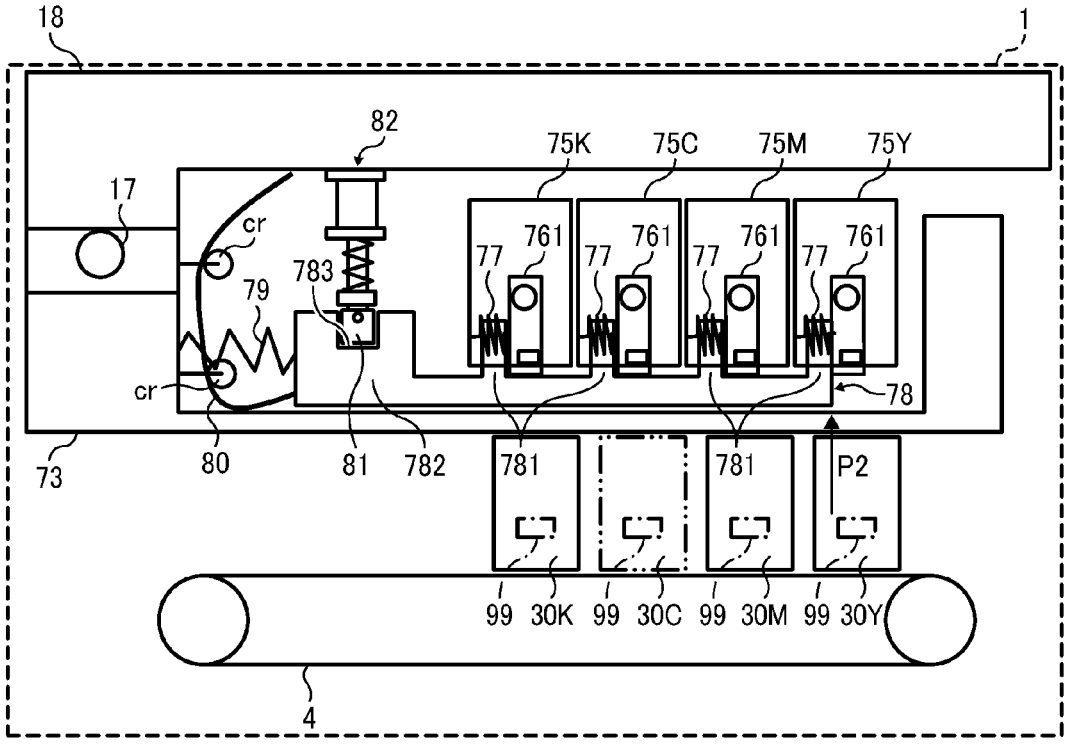
FIG. 5 is a vertical cross-sectional view illustrating the configuration of the image forming apparatus when the upper cover is closed from the state illustrated in FIG. 4.

A description is now given of a configuration of the process unit 30 according to the first illustrative embodiment, with reference to FIGS. 3 to 5. FIG. 3 is a vertical cross-sectional view illustrating an example of a configuration of the process unit 30 installed in the image forming apparatus 1. FIG. 4 is a vertical cross-sectional view illustrating the image forming apparatus 1 when the upper cover 18 is opened. FIG. 5 is a vertical cross-sectional view illustrating the configuration of the image forming apparatus 1 when the upper cover 18 is closed from the state illustrated in FIG. 4. It is to be noted that the process units 30 all have the same basic configuration, differing only in the color of toner used. Therefore, a configuration of the process unit 30Y disposed on the extreme right in FIG. 1 is described in detail below as representative.

The process unit 30Y includes a photoconductor casing 31 housing the photoconductor 3 and so on and a developing casing 32 housing components of the developing device 9. The photoconductor casing 31 and the developing casing 32 are disassemblably assemblable into the process unit 30Y. The photoconductor casing 31 and the developing casing 32 assembled together into the process cartridge 30Y between them define a laser path 33, through which the laser light directed from the LSU 8 onto the photoconductor 3 passes.

The photoconductor casing 31 includes the photoconductor 3, the charging roller 7, a roller cleaning member 26 that cleans the surface of the charging roller 7, the cleaning blade 11, a waste toner collection screw 27 that conveys toner removed from the surface of the photoconductor 3 by the cleaning blade 11 to a waste toner collection part, not shown, a lubricant 28, and a lubricant application brush 29 that scrapes off the lubricant 28 to apply the lubricant to the surface of the photoconductor 3.

The developing casing 32 includes a developer bearing member, which, in the present illustrative embodiment, is a developing roller 34 that bears developer thereon, a supply route 35 from which the developer is supplied to the developing roller 34, a supply screw 36 disposed within the supply route 35, a collection route 37 to which the developer is collected from the developing roller 34, a collection screw 38 disposed within the collection route 37, a restriction member, which, in the present illustrative embodiment, is a doctor blade 39 that restricts a thickness of the developer borne on the developing roller 34, and a toner density sensor 42 that detects a toner density. In the present illustrative embodiment, two-component developer including toner and carrier is used in the developing device 9.

As illustrated in FIG. 3, the developing roller 34 is rotated in a counterclockwise direction at the same speed as the photoconductor 3 in a circumferential direction while the photoconductor 3 is rotated in the clockwise direction, so that the electrostatic latent image formed on the surface of the photoconductor 3 is developed with toner supplied from the developing roller 34. During removal of toner remaining attached to the developing roller 34, the developing roller 34 is reversely rotated in the clockwise direction. At this time, the photoconductor 3 disposed opposite the developing roller 34 is also reversely rotated in the counterclockwise direction.

In the supply route 35, the developer is conveyed by the supply screw 36 and falls from an opening provided to the supply route 35 to be borne on the developing roller 34.

When passing a predetermined gap between the doctor blade 39 and the developing roller 34, the developer borne on the developing roller 34 is restricted to have a predetermined thickness by the doctor blade 39. Then, when reaching a position where the developing roller 34 faces the photoconductor 3 (hereinafter referred to as a photoconductor gap), toner of the developer is electrostatically moved to the photoconductor 3 to develop the electrostatic latent image formed on the photoconductor 3 with the toner. Thereafter, the developer borne on the developing roller 34 is collected to the collection route 37. The developer thus collected to the collection route 37 is conveyed to a downstream portion of the collection route 37 in a direction of conveyance of the developer by the collection screw 38 and thus accumulates at the downstream portion to be conveyed back to the supply route 35 by a conveyance member, not shown. New toner is supplied from the toner cartridge 75 to the supply route 35 via the supply opening 751 based on an amount of toner consumed.

The supply opening 751 of the toner cartridge 75 is detachably connected to a reception opening 321 provided in an upper portion of the developing casing 32. The toner cartridge 75 that stores the toner is detachably supported by a frame-shaped internal cover 73. Returning to FIG. 2, the internal cover 73 is disposed opposite and above the process cartridges 30, and a rear end of the internal cover 73 is hinged coaxially with the upper cover 18 to the rear edge of the image forming apparatus 1 by the hinge 17. Thus, the upper cover 18 and the internal cover 73 together form a double-structure upper cover.

The internal cover 73 has engagement portions 731Y, 731M, 731C, and 731K (hereinafter collectively referred to as engagement portions 731) that detachably support the toner cartridges 75, respectively. The toner cartridges 75, each supported by the internal cover 73, are vertically moved relative to the respective process units 30 to be detachably connected to the upper portions of the process units 30, respectively. Specifically, a recessed connection part 301 is formed in an upward protrusion provided to each process unit 30, and an insertion connection part 752 formed in a lower portion of each toner cartridge 75 is fitted with the recessed connection part 301 from above, so that the toner is supplied from the toner cartridge 75 to the process unit 30 via a communication route r.

As illustrated in FIG. 3, each toner cartridge 75 further includes a shutter 76 that constantly closes the communication path r. A link member, which, in the present illustrative embodiment, is a shutter link member 761, is formed together with the shutter 76, and a protrusion 781 of a shutter switching member 78 is disposed opposite and contactable with the corresponding shutter link member 761. The shutter 76 is constantly biased in a direction that closes off the communication route r by an elastic force generated by a first elastic member, which, in the present illustrative embodiment, is a coil spring 77. A position of the shutter 76 is switched to an open position d1 to open the communication route r.

The shutter switching member 78 is slidably supported by the internal cover 73 and has four protrusions 781 contactable with the respective shutter link members 761 of the toner cartridges 75. Each protrusion 781 presses the corresponding shutter 76 via the shutter link member 761 to switch the position of the shutter 76 to the open position d1. The shutter switching member 78 further has an extended portion 782 at the rear end thereof in the longitudinal direction. An end of the extended portion 782 is pressed by a second elastic member, which, in the present illustrative embodiment, is a compression spring 79 so that the shutter switching member 78 is elastically biased forward, that is, rightward in FIG. 2. The end of the extended portion 782 is connected to the upper cover 18 via an interlock mechanism, which, in the present illustrative embodiment, is a wire 80.

Figure 6:
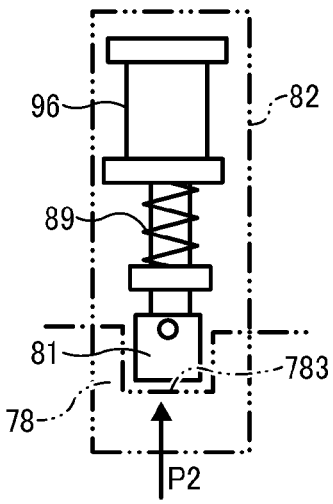
FIG. 6 is an enlarged schematic view illustrating an example of a configuration of a latch mechanism included in the image forming apparatus.

The wire 80 is extended across multiple pulleys cr to transmit a tension thereof to the shutter switching member 78. In conjunction with the opening of the upper cover 18, the wire 80 switches the position of the shutter switching member 78 from a pressing position P1 shown in FIG. 2 to a retracted position P2 shown in FIG. 4 against the elastic force from the compression spring 79. As a result, the protrusions 781 of the shutter switching member 78 are retracted so that the positions of the shutters 76 are switched from the open position d1 to a closed position d0, respectively. A latch mechanism 82 that holds the shutter switching member 78 at the retracted position P2 is provided to the extended portion 782 of the shutter switching member 78. The latch mechanism 82 is constructed of a recessed portion 783 that holds the shutter switching member 78 at the retracted position P2, a latch 81 engageable with the recessed portion 783, and a release mechanism, which, in the present illustrative embodiment, is a solenoid 96 that disengages the latch 81 from the recessed portion 783. FIG. 6 is an enlarged schematic view illustrating an example of a configuration of the latch mechanism 82.

As illustrated in FIG. 6, the latch 81 is formed together with the solenoid 96 at a movable end of the solenoid 96 and is elastically biased by an elastic body, which, in the present illustrative embodiment, is a return spring 89, in a direction of engagement of the latch 81 with the recessed portion 783. In a state in which the shutter switching member 78 reaches the retracted position P2 and the latch 81 engages the recessed portion 783 of the extended portion 782 with the elastic force of the return spring 89, the latch 81 is retracted and disengaged from the recessed portion 783 of the extended portion 782 when the solenoid 96 is turned on. As a result, the shutter switching member 78 is returned from the retracted position P2 to the pressing position P1 by the elastic force of the compression spring 79 as illustrated in FIG. 2.

Figure 7:
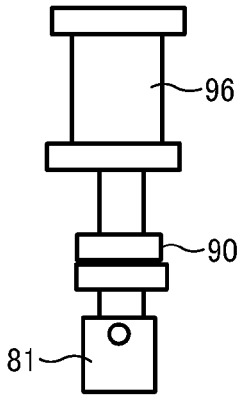
FIG. 7 is an enlarged schematic view illustrating another example of a configuration of the latch mechanism included in the image forming apparatus.
Figure 8:
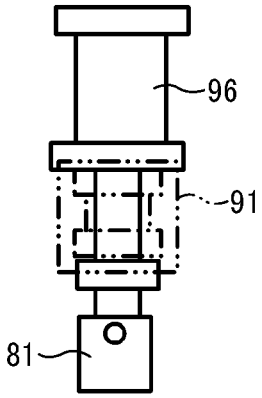
FIG. 8 is an enlarged schematic view illustrating yet another example of a configuration of the latch mechanism included in the image forming apparatus.

Although collision noise may be generated when the solenoid 96 is turned on to disengage the latch 81 from the recessed portion 783, use of the return spring 89 as an elastic member securely reduces the collision noise. Alternatively, in place of the return spring 89, a foam body such as a sponge 90 illustrated in FIG. 7, an air damper 91 illustrated in FIG. 8, or an oil damper, not shown, may be used. In either case, the collision noise is securely reduced. The process units 30, each supported by the image forming apparatus 1, are disposed below and opposite the internal cover 73 having the above-described configuration. The toner density sensors 42, each detecting the toner density, are disposed opposite the respective process units 30. Accordingly, the toner density of the developer within the collection route 37 is magnetically detected, and is adjusted based on the detected data.

Further, detectors 99 are disposed opposite the respective process units 30 to automatically detect installation/detachment states of the respective process units 30 disposed below the internal cover 73. When the absence of at least one process unit 30 is determined by the detectors 99, the control unit, not shown, prohibits operation of the shutter switching member 78 to keep all the shutters 76 closed, thereby reliably preventing toner from spilling outside the image forming part 2 from the toner cartridge 75, the corresponding process unit 30 of which is not installed in the image forming apparatus 1.

Returning to FIGS. 1 and 2, the intermediate transfer belt 4 rotated in the counterclockwise direction is disposed opposite and below the process units 30. The intermediate transfer belt 4 is made of resin and is wound around the pair of support rollers 5 and 6. Specifically, the support rollers 5 and 6 are a tension roller and a secondary transfer opposing roller, respectively. The secondary transfer opposing roller 6 is driven by a drive motor to rotate the intermediate transfer belt 4 in the counterclockwise direction in FIGS. 1 and 2. The photoconductors 3 are disposed to contact a surface of the intermediate transfer belt 4 extended between the secondary transfer opposing roller 6 and the tension roller 5, respectively.

Inside the loop of the intermediate transfer belt 4, the primary transfer rollers 10 are disposed opposite the respective photoconductors 3 with the intermediate transfer belt 4 interposed therebetween. Each primary transfer roller 10 is pressed against the corresponding photoconductor 3 via the intermediate transfer belt 4 by a pressing member such as a spring, and a predetermined primary transfer bias used for the primary transfer is applied to each primary transfer roller 10 by a primary transfer bias application member, not shown. A leading end of a blade provided to the belt cleaning device 15 is pressed against the surface of the intermediate transfer belt 4 to remove residual toner or paper dust remaining attached to the surface of the intermediate transfer belt 4. The secondary transfer roller 12 is provided opposite the secondary transfer opposing roller 6 with the intermediate transfer belt 4 interposed therebetween. A drive force is supplied to the secondary transfer roller 12 by a drive gear, not shown. Further, a predetermined secondary transfer bias used for the secondary transfer is applied to the secondary transfer opposing roller 6 by a secondary transfer bias application member, not shown.

The intermediate transfer belt 4, the primary transfer rollers 10, the belt cleaning device 15, and the primary and secondary transfer bias application members together constitute a transfer device 55 and are controlled by the transfer device 55 so that the toner images formed on the photoconductors 3 are primarily transferred onto the intermediate transfer belt 4 one atop the other to form a single full-color toner image on the intermediate transfer belt 4, and the full-color toner image thus formed on the intermediate transfer belt 4 is then secondarily transferred onto the sheet S.

Features of the present illustrative embodiment are described in greater detail below. The shutter switching member 78 is driven by the wire 80 when the upper cover 18 is opened as illustrated in FIG. 4. As a result, each shutter 76 is moved to the closed position d0 by the coil spring 77 and the shutter switching member 78 is held by the latch 81 at the retracted position P2 as illustrated in FIG. 4, which corresponds to the state indicated in column b of the graph shown in FIG. 9. In a case in which the detectors 99 determine that at least one process unit 30 is not present when the upper cover 18 is closed as illustrated in FIG. 5 after the state illustrated in FIG. 4, the shutters 76 remain closed so that the toner is prevented from spilling from the toner cartridges 75, which corresponds to the state indicated in column d in the graph shown in FIG. 9. Power is supplied to the latch mechanism 82 only when the detectors 99 detect the presence of all the process units 30 in the image forming apparatus 1 so that the latch 81 is released from the recessed portion 783 as illustrated in FIG. 2. As a result, the shutter switching member 78 is returned to the pressing position P1 by the elastic force of the compression spring 79 and the shutters 76 are moved to the open position d1, which corresponds to the state indicated in column e in the graph shown in FIG. 9.

Figure 10:
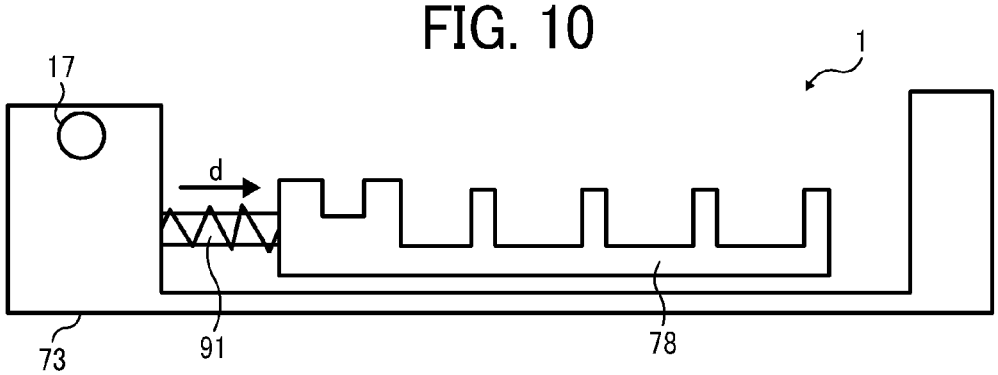
FIG. 10 is a schematic view illustrating an example of a configuration of an image forming apparatus according to a variation of the first illustrative embodiment.

A description is now given of a variation of the first illustrative embodiment, with reference to FIG. 10. FIG. 10 is a schematic view illustrating an example of a configuration of the image forming apparatus 1 according to the variation of the first illustrative embodiment.

In the variation, in place of the compression spring 79, a rubber member 91 is used as the second elastic member. The rubber member 91 constantly presses the shutter switching member 78 in the direction of arrow d in FIG. 10. As a result, the same effects as those achieved by the first illustrative embodiment using the compression spring 79 can be achieved.

Figure 11:
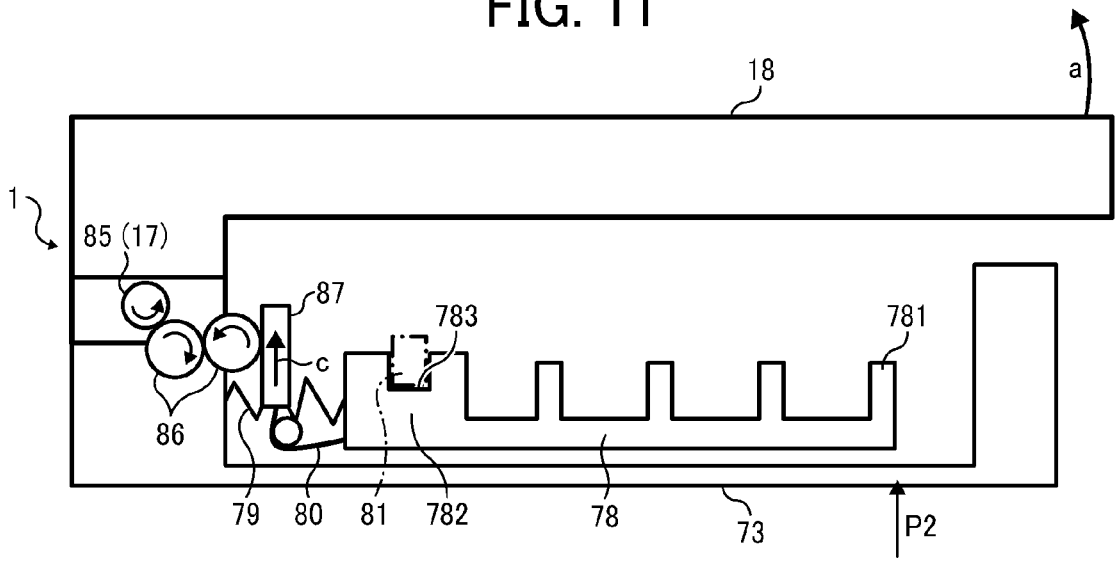
FIG. 11 is a schematic view illustrating an example of a configuration of an image forming apparatus according to a second illustrative embodiment.

A description is now given of a second illustrative embodiment of the present invention, with reference to FIG. 11. FIG. 11 is a schematic view illustrating an example of a configuration of the image forming apparatus 1 according to the second illustrative embodiment.

In the second illustrative embodiment, in addition to the wire 80, gears and a rack are also used as the interlock mechanism. In FIG. 11, reference numeral 85 denotes a gear formed together with a shaft, not shown, which operates in a similar manner to the hinge 17 according to the first illustrative embodiment, reference numeral 86 denotes engagement gears that engage the gear 85, and reference numeral 87 denotes a rack that engages the engagement gears 86. When the upper cover 18 is opened upward in a direction indicated by an arrow a in FIG. 11, the gear 85 and the engagement gears 86 are rotated in directions indicated by arrows in FIG. 11, respectively, so that the rack 87 is moved in a direction indicated by an arrow c. As a result, the shutter switching member 78 is pulled by the wire 80 to the retracted position P2 with the above-described uncomplicated configuration.

Figure 12:
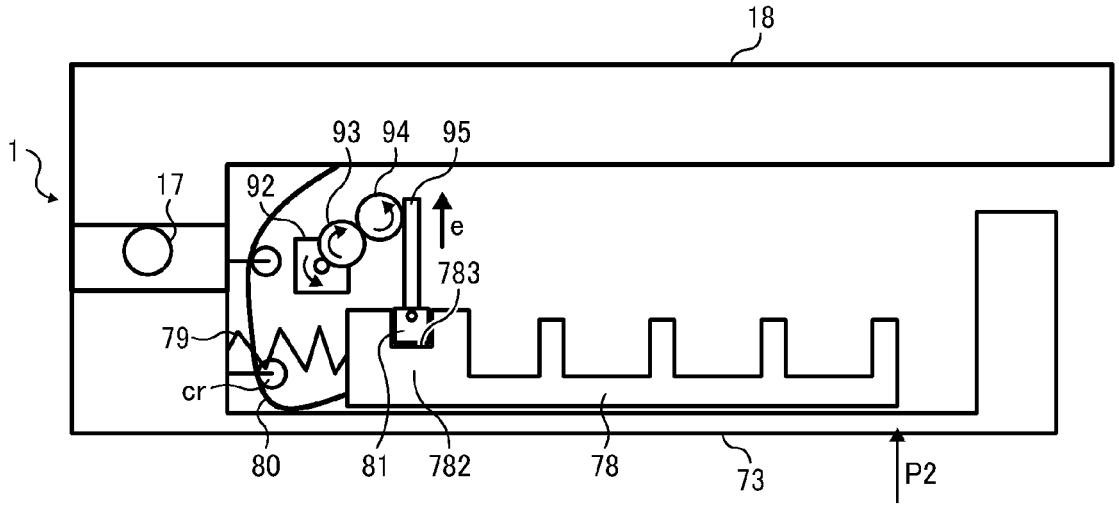
FIG. 12 is a schematic view illustrating an example of a configuration of an image forming apparatus according to a third illustrative embodiment.

A description is now given of a third illustrative embodiment of the present invention, with reference to FIG. 12. FIG. 12 is a schematic view illustrating an example of a configuration of the image forming apparatus 1 according to the third illustrative embodiment.

In the third illustrative embodiment, a motor 92, an idler gear 93, a clutch 94, and a rack 95 engage with each other, respectively. The rack 95 also functions as a latch and constitutes the release mechanism that releases the latch 81 from the recessed portion 783. In a case in which power is not supplied to the clutch 94, the rack 95 holds the shutter switching member 78 at the retracted position P2 by gravity when the upper cover 18 is opened, and is transformed to the state illustrated in FIG. 12 when the upper cover 18 is closed. When the power is supplied to the motor 92 and the clutch 94 in the state illustrated in FIG. 12, the rack 95 is moved in a direction indicated by arrow e so that the shutter switching member 78 is returned to the pressing position P1 and thus the shutters 76 are moved to the open position d1 to open the communication path r.

The foregoing illustrative embodiments are applicable not only to the image forming apparatus 1 described above but also to an image forming apparatus such as a copier, printer, facsimile machine, and multifunction device having two or more of copying, printing, and facsimile capabilities. In such a case, toner spilling and scattering outside the image forming part from the toner container can be prevented in a manner similar to the foregoing illustrative embodiments.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus, comprising:

an upper cover;

an image forming unit comprising:

an image carrier; and a developing device to develop an electrostatic latent image formed on the image carrier with developer;

a toner container detachably connectable to the developing device to supply toner to the developing device through an opening in the toner container;

a shutter provided to the toner container and biased by a first elastic member in a direction to close the opening of the toner container with an elastic force;

a link member integrated with the shutter;

a shutter switching member to switch a position of the shutter to an open position against the elastic force of the first elastic member by applying an elastic force of a second elastic member to the link member and moving the link member to a pressing position; and an interlock mechanism to retract the shutter switching member from the pressing position against the elastic force of the second elastic member in conjunction with opening of the upper cover of the image forming apparatus, the opening being closed with the shutter receiving the elastic force of the first elastic member by switching the shutter switching member to a retracted position in conjunction with the opening of the upper cover.

2. The image forming apparatus according to claim 1, further comprising:

a latch mechanism to hold the shutter switching member at the retracted position upon closing of the opening of the toner container with the shutter;

a release mechanism to release the latch mechanism upon power supply to the release mechanism; and a detector to detect presence or absence of the image forming unit, wherein the release mechanism releases the latch mechanism upon detection of presence of the image forming unit by the detector after the upper cover is closed to switch the shutter to the open position by moving the shutter switching member to the pressing position by the elastic force of the second elastic member.

3. The image forming apparatus according to claim 2, further comprising a motor that provides a drive force by which the release mechanism releases the latch mechanism.

4. The image forming apparatus according to claim 2, wherein the release mechanism is a solenoid.

5. The image forming apparatus according to claim 4, wherein the solenoid comprises an elastic body.

6. The image forming apparatus according to claim 5, wherein the elastic body is a spring.

7. The image forming apparatus according to claim 5, wherein the elastic body is a foam body.

8. The image forming apparatus according to claim 5, wherein the elastic body is an air damper.

9. The image forming apparatus according to claim 5, wherein the elastic body is an oil damper.

10. The image forming apparatus according to claim 1, further comprising:

an image forming part employing a tandem-type intermediate transfer system, the image forming part comprising a transfer unit to primarily transfer the toner image formed on the image carrier onto an intermediate transfer body disposed opposite the image carrier and secondarily transfer the toner image from the intermediate transfer body onto a recording medium; and multiple image forming units each constructed of the image carrier and the developing device and disposed opposite the intermediate transfer body along a direction of rotation of the intermediate transfer body.

11. The image forming apparatus according to claim 1, wherein the interlock mechanism is a wire.

12. The image forming apparatus according to claim 1, wherein the interlock mechanism is constructed of a rack and a gear.

13. The image forming apparatus according to claim 1, wherein the second elastic member is a spring.

14. The image forming apparatus according to claim 1, wherein the second elastic member is made of rubber.

* * * * *